US006193201B1

(12) United States Patent
Babcock

(10) Patent No.: US 6,193,201 B1
(45) Date of Patent: Feb. 27, 2001

(54) CONDIMENT CONTAINER SUPPORT DEVICE

(76) Inventor: Jerry Babcock, 410 Wilson St., Anoka, MN (US) 55303

( * ) Notice: Subject to any disclaimer, the term of this patent is extended or adjusted under 35 U.S.C. 154(b) by 0 days.

(21) Appl. No.: 09/231,758

(22) Filed: Jan. 15, 1999

Related U.S. Application Data

(60) Provisional application No. 60/072,791, filed on Jan. 16, 1998.

(51) Int. Cl.[7] ..... A47G 29/00

(52) U.S. Cl. ..... 248/311.2; 220/737; 229/904; 229/906; 248/205.3

(58) Field of Search ..... 229/906, 402, 229/931, 904; 248/205.3, 311.2; 220/735, 694, 697, 359.1, 759, 737, 738; 224/148.4, 906

(56) References Cited

U.S. PATENT DOCUMENTS

| | | | | |
|---|---|---|---|---|
| 1,627,042 | * | 5/1927 | Mason et al. | 229/4.5 X |
| 1,771,760 | * | 7/1930 | MacLellan | 229/931 |
| 2,831,647 | * | 4/1958 | MacKay | 248/205.3 |
| 2,834,533 | * | 5/1958 | Carew | 229/402 |
| 3,334,733 | * | 8/1967 | Ebelhardt | 206/216 |
| 3,351,515 | * | 11/1967 | Muttera, Jr. | 428/40.1 X |
| 3,367,610 | * | 2/1968 | Lindquist | 248/110 |
| 3,866,873 | * | 2/1975 | Bohli | 248/205 A |
| 4,022,372 | * | 5/1977 | Graser | 229/931 |
| 4,620,631 | * | 11/1986 | Bartelt | 206/217 |
| 4,653,711 | * | 3/1987 | Marshell | 248/205.3 |
| 4,693,441 | * | 9/1987 | Conway | 206/813 X |
| 4,854,466 | * | 8/1989 | Land, Jr. | 220/23.83 |
| 5,429,262 | * | 7/1995 | Sharkey | 220/23.83 |
| 5,667,119 | * | 9/1997 | Florence | 224/482 |
| 5,671,503 | * | 9/1997 | Uebelacker et al. | 220/737 |
| 5,960,947 | * | 10/1999 | Dimelis et al. | 206/216 |

* cited by examiner

*Primary Examiner*—Allan N. Shoap
*Assistant Examiner*—Joe Merek
(74) *Attorney, Agent, or Firm*—Patterson, Thuente & Skaar, P.A.

(57) ABSTRACT

A condiment container support device, the device being attachable to a supporting structure for supporting a condiment container includes a receptacle structure defining at least one condiment container receptacle aperture. A flange is resiliently operably coupled to the receptacle structure. And, an attachment for attaching the flange to a supporting structure surface to cantilever the receptacle structure substantially orthogonally with respect to the flange attached to the supporting structure surface. A method for supporting a condiment container is included.

1 Claim, 4 Drawing Sheets

CONDIMENT CONTAINER SUPPORT DEVICE

RELATED APPLICATION

This application claims the benefit of U.S. Provisional Application No. 60/072,791, filed Jan. 16, 1998.

FIELD OF THE INVENTION

The present invention generally pertains to a condiment container support structure. Specifically, the invention relates to a receptacle adapted to receive and support condiment containers of various shapes and sizes. More specifically the invention provides an adjustable receptacle for securely supporting condiment containers by being integrally adaptable to food trays, boxes and similar containers having various geometric shapes.

BACKGROUND OF THE INVENTION

The present invention relates to a method and device for supporting condiment containers which contain supplemental foods such as catsup, cream, salad dressing, sauce and the like. More specifically the invention provides a universal condiment container support which is easily attached to primary food or takeout containers to promote ease in the handling, organizing and transporting of the supplemental foods.

Prior art condiment carriers and support devices generally require significant modifications of the primary food container before the support structure could be attached, thus increasing manufacturing costs. Further, some of the devices require a certain way of installing the condiment support and/or carrier making it inconvenient for users. This is especially uneconomical and undesirable in fast food service operations. Moreover, some of the prior art devices are cumbersome to store and may crowd out the food container if dispensed by the host within, for example, a takeout box. Yet another limitation of prior art condiment carriers is the fact that they can be attached only externally and do not provide options for internal attachment. In certain cases attachment of a condiment carrier internally is preferred to eliminate spillage and promote ease of handling.

Another limitation of the prior art is the fact that the condiment carrier or support is not easily adaptable to various geometric shapes. For example, prior art condiment support structures require that the container surface be either substantially flat or curvilinear and the user has to sort out/select among various types to determine which one to use with any primary food container. This means that at least two types of support structures should be stocked thus unduly increasing manufacturing and operating costs. Further, prior art support structures are rather cumbersome to use and bulky to store thus being, generally, unsuitable for fast food and takeout services.

Yet another limitation of the prior art is the lack of a condiment container or support structure which can provide more than one condiment and is easily attachable to a primary food container. Many restaurants and fast food chains prepare various menus which require different types of condiments. Therefore it is desirable to attach more than one condiment carrier to a primary food container.

Accordingly, there is need for a universal condiment support device which is easy to use while overcoming the limitations of the prior art. The present invention advantageously provides several distinguishing features structured to promote ease of use while enhancing operational efficiency and cost effectiveness.

SUMMARY OF THE INVENTION

The present invention provides a condiment container support device which is attachable to flat, curvilinear, convoluted and cylindrical surfaces or a combination thereof. The support structure includes preferably a compressed cardboard fiber sheet or equivalent with a cut out portion at the fore end and a flange at the aft end. The cut out at the fore end defines a substantially circular receptacle with a lip formed around the perimeter thereof. The flange is resiliently structured to support the fore end in a substantially horizontal orientation. Further, the flange includes an upper and lower surface on both sides of which a piece of label tape is installed. The label tape is preferably a removable top coat which covers an adhesive backing at the base. In the preferred embodiment, the adhesive base is directly applied to the cardboard fiber sheet on both sides.

The invention provides a user with a selection of condiment support devices to be attached to substantially flat and/or curvilinear surfaces. Specifically, the invention, inter alia, utilizes an adjustable adhesive flange to adapt to various shapes. The basic structure includes a creased-flange formed at the aft end of the device. The creased-flange includes floating ends to wrap around or conform to non-linear surfaces. The creased-flange is preferably treated with an adhesive coating on both sides to provide users with the option to attach the receptacle to a primary food container without regard to which of the adhesive-treated side of the creased-flange is exposed. Further, if the adhesive on one side fails to adequately stick, the user has the option to try the other end. More importantly, the application of adhesive coating on both sides of the creased-flange including the removable label tape provides a light weight and yet efficient structural reinforcement to the underlying cardboard fiber sheet.

Yet another aspect of the invention includes a condiment support structure to support at least two condiment carriers. The general structure includes a fore section with preferably two cutouts adjacently set with an adjoining common lip around the perimeter of the cutouts. A creased-flange is formed at the aft section and extends, preferably, at least equal to the length of the lip. Further, the creased-flange includes a floating section which is used to adjust/adapt the support device of the present invention around curvilinear food containers.

The present invention is a condiment container support device, the device being attachable to a supporting structure for supporting a condiment container. The condiment container includes a receptacle structure defining at least one condiment container receptacle aperture. A flange is resiliently operably coupled to the receptacle structure. And, an attachment for attaching the flange to a supporting structure surface to cantilever the receptacle structure substantially orthogonally with respect to the flange attached to the supporting structure surface. Further, the present invention is a method for supporting a condiment container.

With these and other features advantages and objects of the present invention which may become apparent, the various aspects of the invention may be more clearly understood by reference to the following detailed description of the preferred embodiment, the appended claims and to the several drawings herein contained.

BRIEF DESCRIPTION OF THE DRAWINGS

FIG. 1-B is a sectional view of the flange element depicting the various layers about section A—A;

FIG. 1-C is a sectional view of the lip element about section A—A;

FIG. 1-D is a sectional view of the flange of FIG. 1-B with adhesive on one side;

FIG. 2-B is a sectional view of the flange element depicting the various layers about section A—A;

FIG. 2-C is a sectional view of the lip element about section B—B;

FIG. 3-B is a sectional view of the flange element depicting the various layers about section A—A;

FIG. 3-C is a sectional view of the lip element about section B—B;

FIG. 4-B is a section view of the flange element depicting the various layers about section A—A;

FIG. 4-C is a section view of the lip element about section B—B;

DESCRIPTION OF THE PREFERRED EMBODIMENT

Figure 1A:
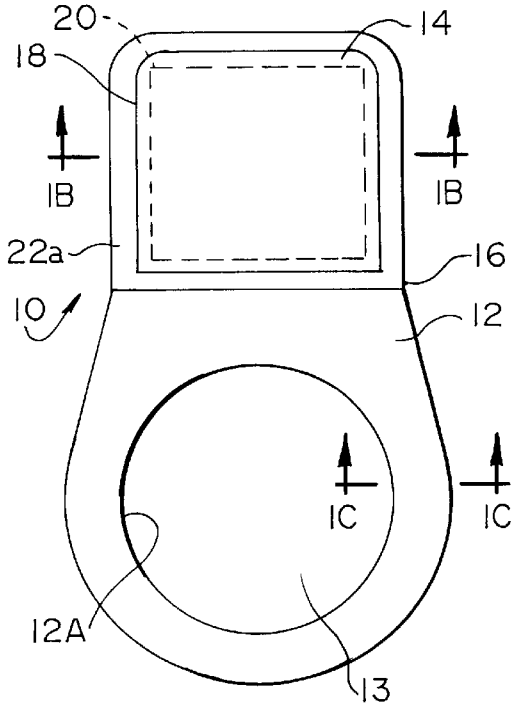
FIG. 1-A is a plan view presenting a support for a small size condiment carrier.
Figure 1B:
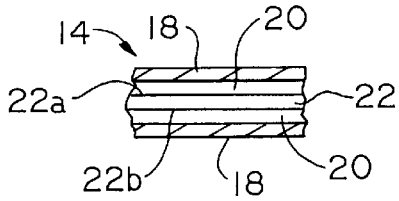
Figure 1C:
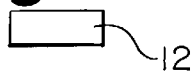
Figure 1D:
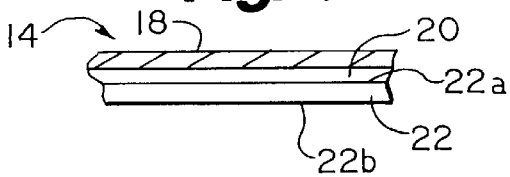

The present invention anticipates the various shapes of food containers and condiment carriers and is advantageously adaptable for attachment to containers on which the condiment carrier is independently supported. Particularly, the invention provides hitherto unavailable advantages of ease of use, storage and universal applicability. Further, the invention enables the support of multiple condiment carriers to thereby segregate various types of condiments while promoting transportability and efficiency in packaging particularly in carry out and fast food services.

A plan view of a support device of the present invention is depicted in FIG. 1-A. In particular, condiment container support 10 includes a fore receptacle section 12, having a lip 12*a* and aft section flange 14. The two sections 12, 14 are resiliently connected at crease 16. The crease 16 is bidirectional, permitting the flange 14 to bend either of two directions with respect to lip 12*a*. The receptacle section 12 includes a receptacle 13, the receptacle 13 being an aperture defined by lip 12*a* which extends about the perimeter thereof. In the preferred embodiment the receptacle 13 is substantially circular. However, as is well known to those skilled in the art, various shapes could be made in the manner of the receptacle 13 disclosed herein in order to accommodate a variety of condiment container shapes.

FIG. 1-B depicts a cross-sectional view of flange 14. Specifically, flange 14 includes layers of label tape 18 on both sides 22*a*, 22*b* covering a sub-layer of adhesive 20 applied on top of cardboard fiber sheet 22. One of the unique aspects of the present invention includes the structure of flange 14. Adhesive layer 20 is preferably applied to one of the sides 20*a*, 20*b*, but may be applied on both of the opposed sides 22*a*, 22*b* of sheet 22 to enable users to adhere support 10 to a supporting structure on either side of flange 14. When support 10 is adhered to a container surface, receptacle section 12 is cantilevered extending outward in a substantially vertical orientation against flange 14. In this arrangement support 10 is resilient about crease 16. As is shown in FIG. 1-C, receptacle section 12 is preferably a homogenous cardboard sheet defining the receptacle to receive a condiment container. Typically, the embodiment presented in FIG. 1-A is suited to support a small size condiment container.

Figure 5:
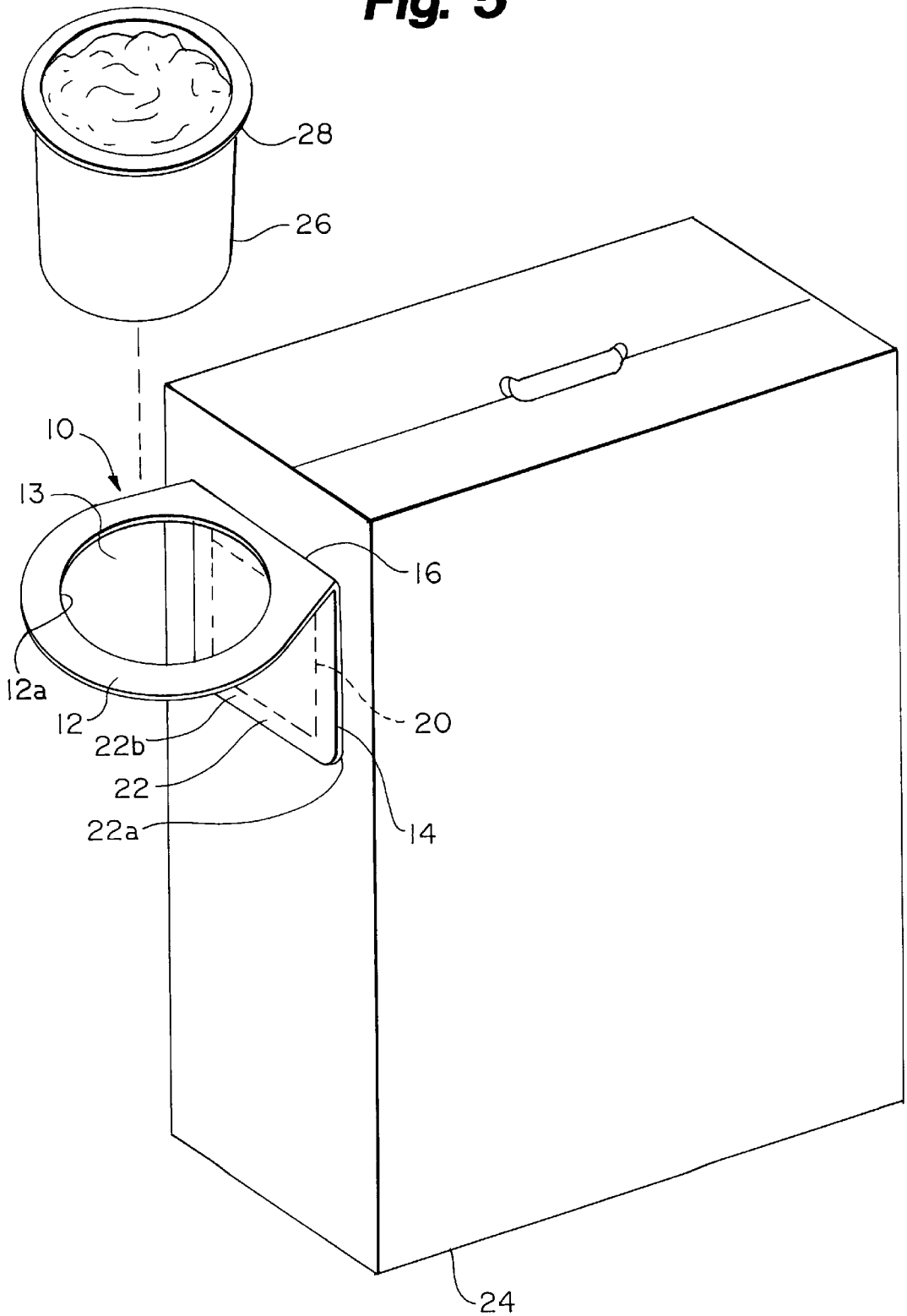
FIG. 5 is a perspective view of the condiment container support device of FIG. 1 adhered to a supporting food container.

FIG. 5 depicts the support 10 adhered to a food container 24. In order to prepare for use of the support 10, the support 10 is bent along crease 16 such that flange 14 is substantially orthogonally disposed with respect to receptacle section 12. The crease 16 is designed to have sufficient resilience to support the weight of a range of known condiment containers 26 and their contents with substantial downward deflection of receptacle section 12.

Adherence is effected by removing label tape 18 to expose the underlying adhesive 20 on side 22*a* of flange 14. The adhesive 20 is then pressed into contact with the supporting surface of the container 24, thereby supporting receptacle section 12 in a cantilever fashion.

The condiment container 26 may then be lowered into the receptacle 13. The receptacle 13 is preferably sized to accommodate a known container 26 such that the lip 28 of the container 26 engages the lip 12*a* that defines the receptacle 13.

Figure 2A:
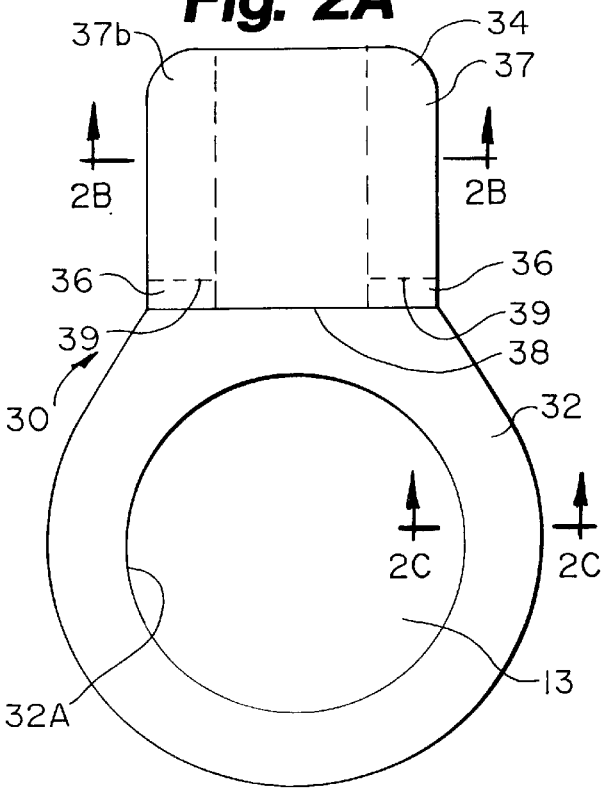
FIG. 2-A is a plan view presenting a support for a large size condiment carrier.
Figure 2B:
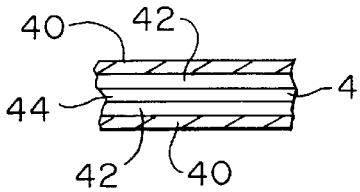
Figure 2C:
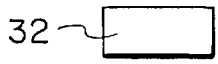
Figure 6:
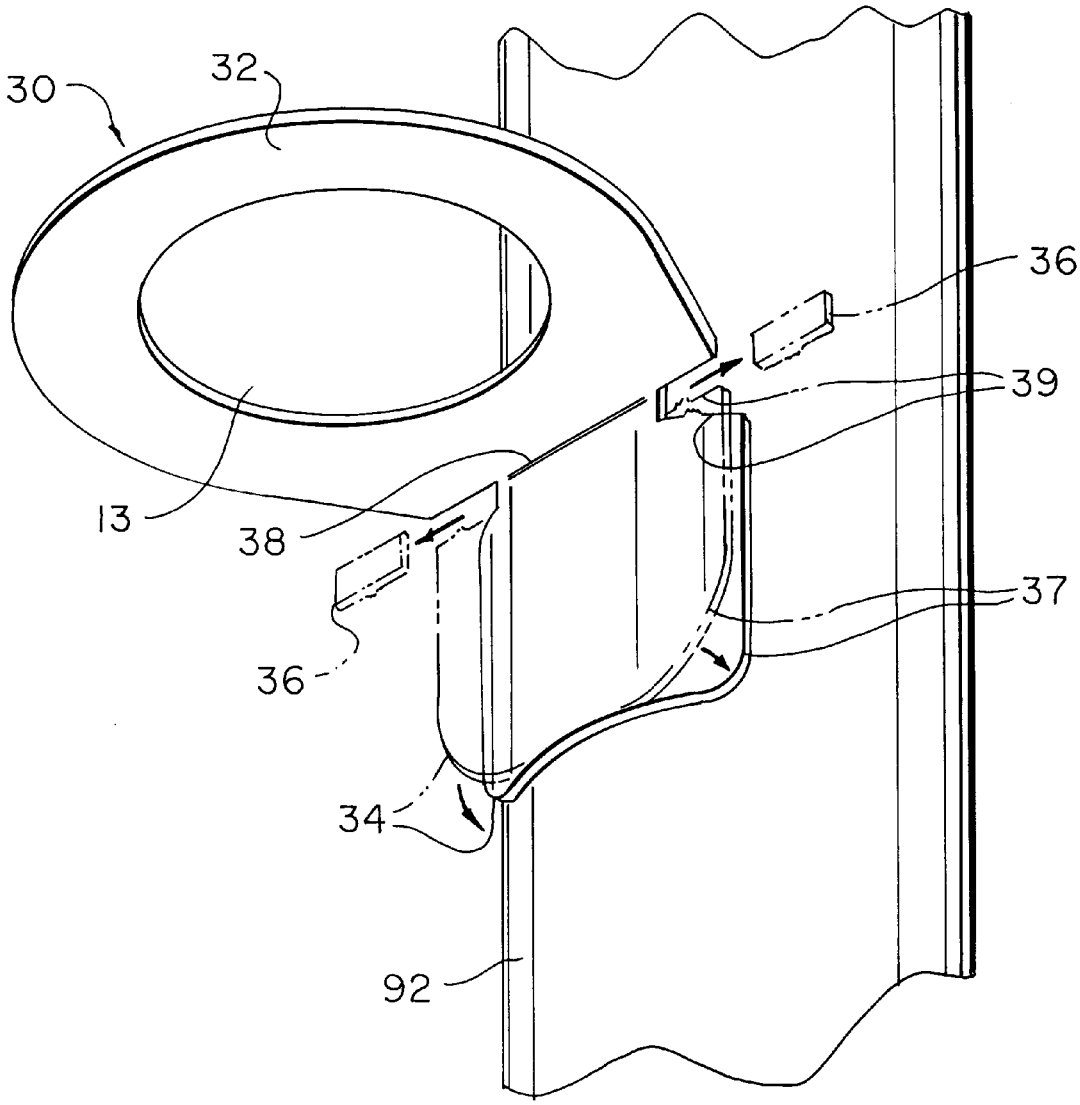
FIG. 6 is a perspective view depicting a view of the underside of the condiment container support of FIG. 5, adhering to a supporting food container.

Referring next to FIG. 2-A, a condiment container support device 30 is presented. The embodiment includes a fore receptacle section 32, having a lip 32*a* defining a receptacle 13 for receiving a relatively large condiment carrier. Further, flange 34 is resiliently connected at crease 38. The embodiment depicts one of the many innovative features of the present invention. Specifically, cut out sections 36 are formed to enable adjustability of flange 34 while retaining the original shape of the receptacle 13 unchanged. As will be seen hereinbelow, the cutout section 36 enables support 30 to wrap around curvilinear surfaces such as cylindrical surface 92 (FIG. 6).

Referring next to FIG. 2-B, a cross-sectional view of flange 34 is presented. Flange 34 is preferably composed of adhesive and resilient structural members. Specifically, flange 34 includes layers of label tape 40 on both sides covering a sub-layer of adhesive 42 applied on top of cardboard fiber sheet 44. One of the unique aspects of the present invention includes the structure of flange 34. Adhesive layer 40 is preferably applied on both sides to enable users to adhere support 30 on either side of flange 34 to a supporting structure. When support 30 is adhered to a container surface, receptacle section 32 is cantilevered extending outward in a substantially orthogonal orientation with respect to flange 34. In this arrangement support 30 is resilient about crease 38. As is shown in FIG. 2-C, receptacle section 32 is preferably a homogenous cardboard sheet defining the receptacle 13 to receive a condiment container. Typically, the embodiment presented in FIG. 2-A is suited to support a large size condiment container. Flange 34 is structured with cutout 36 such that flexible adhesive flaps 37 are formed at the side margins 39 of flange 34. This arrangement enables the support device to be attached to the walls of food containers with cylindrical or curvilinear surfaces by curving the flaps 37 to conform generally to the curvilinear supporting surface. Cut out sections 36 include a cover label and adhesive separable/tearable at contact surface 39. Accordingly, when flange 34 is attached to, for example, a cylindrical container the flaps 37 at cutout 36 are flexibly wrapped around the cylinder wall thus providing a secure adhesion to the surface.

Figure 3A:
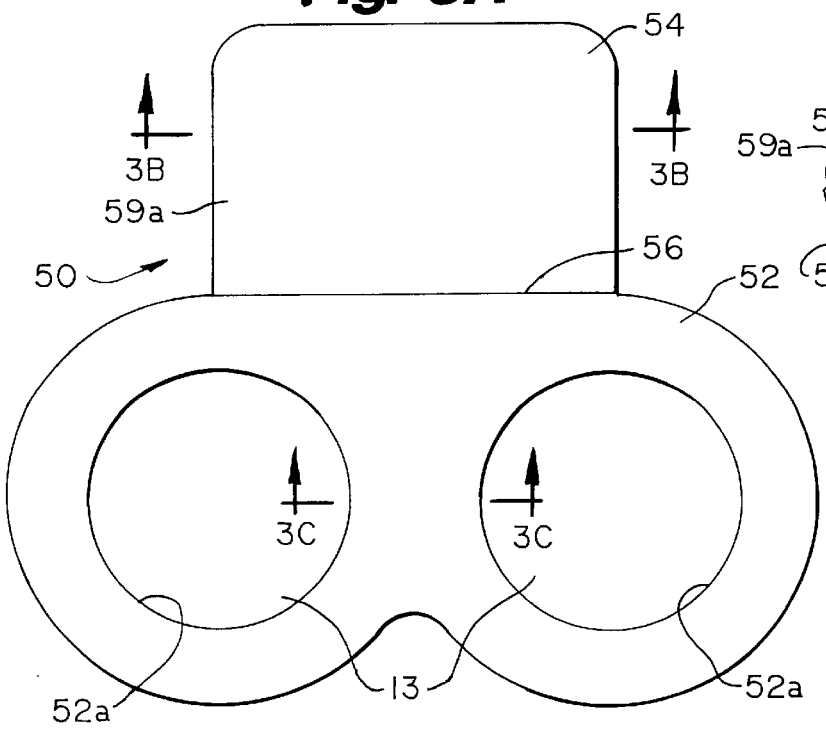
FIG. 3-A is a plan view presenting a support for a small size two cup condiment carrier.
Figure 3B:
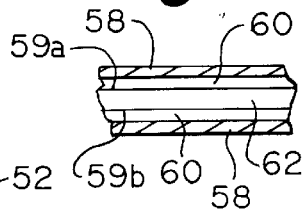
Figure 3C:
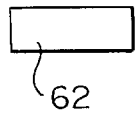

FIG. 3 shows yet another embodiment in which more than one condiment container is supported by support device 50 of the present invention. The embodiment includes a fore receptacle section 52, having a lip 52*a* defining two adjacent receptacles 13 therein. Flange 54 is resiliently connected to receptacle section 52 at crease 56.

FIG. 3-B depicts a cross-sectional view of flange 54. Specifically, flange 54 includes layers of label tape 58 on one or both sides 59*a,* 59*b* covering a sub-layer of adhesive 60 applied on top of cardboard fiber sheet 62. In this arrangement support 50 is resilient about crease 56. As is shown in FIG. 3-C, receptacle section 52 is preferably a homogenous cardboard sheet defining the receptacles 13 to receive at least two condiment containers. Typically, flange 54 and resilient crease 56 will be reinforced to accommodate the weight of two or more condiments received and carried at the receptacles 13.

Figure 4A:
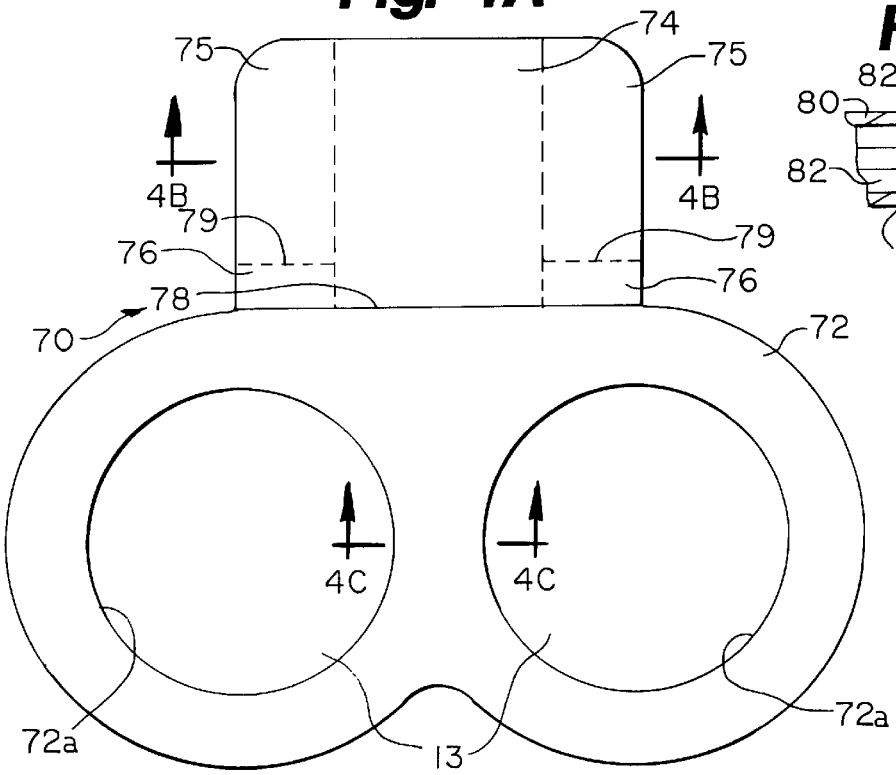
FIG. 4-A is a plan view presenting a support for a large size two cup condiment carrier.
Figure 4B:
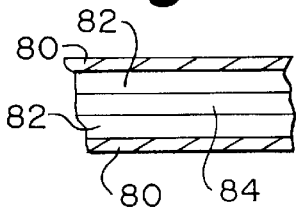
Figure 4C:
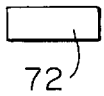

Referring next to FIG. 4 another embodiment is presented in which more than one condiment container is supported by support device 70 of the present invention. The embodiment includes a fore receptacle section 72, having a lip 72*a* defining two adjacent receptacles 13 therein. Flange 74 is resiliently connected to receptacle section 72 at crease 78. The embodiment depicts one of the many innovative features of the present invention. Specifically, cut out sections 76 are formed to enable adjustability of flange 74 while retaining the original shape of the receptacle unchanged. As will be seen hereinbelow, the cutout section enables support 30 to wrap around curvilinear surfaces.

Referring next to FIG. 4-B, a cross-sectional view of flange 74 is presented. Flange 74 is preferably composed of adhesive and resilient structural members. Specifically, flange 74 includes layers of label tape 80 on both sides covering, a sub-layer of adhesive 82 applied on top of cardboard fiber sheet 84. Adhesive layer 80 is preferably applied on both sides to enable users to stick support 70 on either side. When support 70 is adhered to a container surface, receptacle section 72 is cantilevered extending outward in a substantially vertical orientation against flange 74. In this arrangement support 70 is resilient about crease 78. As is shown in FIG. 4-C, receptacle section 72 is preferably a homogenous cardboard sheet defining the receptacle to receive a condiment container. Typically, the embodiment presented in FIG. 4-A is suited to support two large size condiment containers. Flange 74 is structured with cutout 76 such that flexible adhesive flaps 75 are formed therein. This arrangement enables the support device to be attached to the walls of food containers with cylindrical or curvilinear surfaces. Cut out sections 76 include a cover label and adhesive separable/tearable at contact surface 79. Accordingly, when flange 74 is attached to, for example, a cylindrical container, the flaps 75 at cutout 76 are flexibly wrapped around the cylinder wall thus providing a secure adhesion to the surface.

It should be noted that the size and number of receptacles for each support device may vary. Depending upon the size, number and anticipated weight of the condiment carrier to be supported, the flange, receptacle section and the resilient connection between them could be reinforced to provide sufficient structural integrity to support the weight.

Accordingly, the present invention utilizes structures which cooperate with a food and condiment carrier to promote efficient organization, handling, transportation and segregation of condiment foods. The support device of the present invention is typically dispensed with a food container box or a carryout container. The user may attach the support to carry condiment as needed. In the alternate, the support device may be pre-attached to food containers. In this case the user may flip-open the support device to cantilever the lip structure and thereby use the receptacle to store/place the condiment container. Further, depending upon the structure of the food container box, the support device of the present invention may be placed inside the box.

While the preferred embodiments of the present invention have been shown and described, it will be obvious to those skilled in the art that changes, variations and modifications may be made therein without departing from the present invention in its broader aspects and, therefore, the aim in the appended claims is to cover such changes and modifications as fall within the scope and spirit of the invention.

What is claimed is:

1. A condiment container support device, the device being attachable to a supporting structure for supporting a condiment container, comprising:

a receptacle structure defining at least one condiment container receptacle aperture;

a flange configured for being resiliently operably coupled to said receptacle structure, said flange includes a first surface and an opposed second surface, both of said flange first and second surfaces comprising an adhesive layer formed thereon;

a bidirectional crease resiliently operably coupling said receptacle structure and said flange; and wherein the adhesive is capable of attaching said flange to a supporting structure surface to cantilever the receptacle structure substantially orthogonally with respect to the flange when the flange is attached to the supporting structure.

* * * * *